United States Patent [19]

Buchele

[11] 3,930,449

[45] Jan. 6, 1976

[54] TIME DELAY INITIATOR

[75] Inventor: Reuben J. Buchele, Lynn Haven, Fla.

[73] Assignee: The United States of America as represented by the Secretary of the Army, Washington, D.C.

[22] Filed: May 6, 1974

[21] Appl. No.: 467,768

[52] U.S. Cl. ..... 102/70.2 R; 102/82

[51] Int. Cl.[2] ..... F42C 11/00

[58] Field of Search ..... 102/70.2 R, 82, 84

[56] References Cited

UNITED STATES PATENTS

| | | | |
|---|---|---|---|
| 2,998,776 | 9/1961 | Morgan | 102/70.2 R |
| 3,088,409 | 5/1963 | Yavelberg | 102/70.2 R |
| 3,420,176 | 1/1969 | Pope | 102/70.2 R |
| 3,570,404 | 3/1971 | Pope | 102/70.2 R |
| 3,875,863 | 4/1975 | Bymoen et al. | 102/70.2 R |

*Primary Examiner*—Samuel Feinberg
*Assistant Examiner*—C. T. Jordan
*Attorney, Agent, or Firm*—Nathan Edelberg; Robert P. Gibson; Jack W. Voigt

[57] ABSTRACT

A self-contained, accurately timed ignitor system for igniting a rocket motor within a preselected time interval. The timing period is initiated by an electrical input signal. A self-contained, spring wound timer and power source package, carried within the motor nozzle and used in igniting the rocket motor, is activated by the input signal.

5 Claims, 2 Drawing Figures

TIME DELAY INITIATOR

DEDICATORY CLAUSE

The invention described herein may be manufactured, used, and licensed by or for the Government for governmental purposes without the payment to me of any royalties thereon.

SUMMARY OF THE INVENTION

A self-contained, time delay igniter system provides for rocket motor ignition within a preselected adjustable time interval. Start of the time period is by an electrical signal which may be generated just prior to launching a rocket or separation of the activated stage from a preceeding rocket stage after launch. After physical connection to the electrical triggering source is broken, the timed ignition system activates the rocket motor. When the ignition system is activated dormant thermal batteries are energized simultaneously with a mechanical, spring wound timer. The delay time of the timer allows the thermal batteries output potentials to rise to or above the desired output voltage level before switching the batteries across pyrotechnic squibs to activate the motor.

DESCRIPTION OF THE PREFERRED EMBODIMENT

Figure 1:
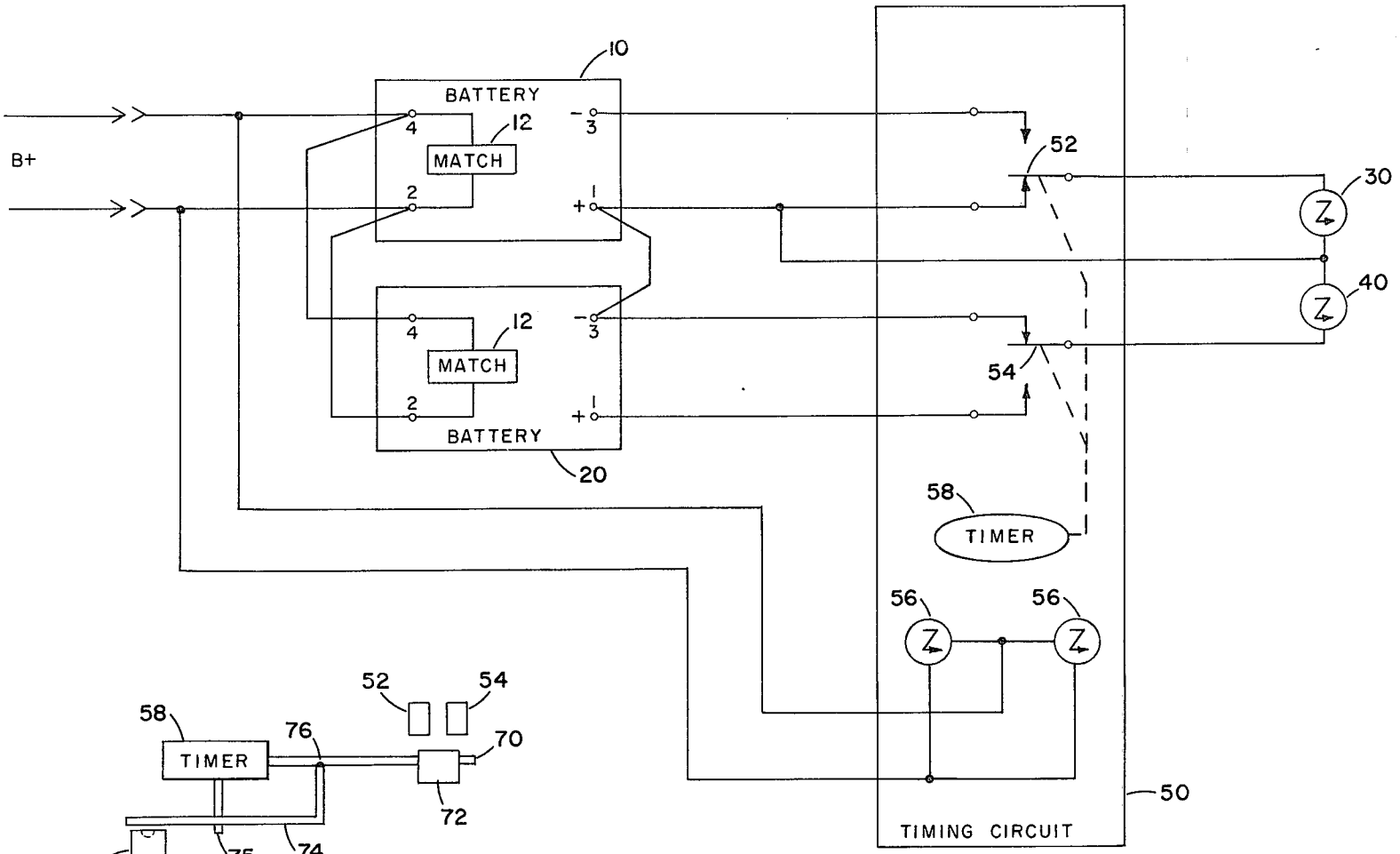
FIG. 1 is a simplified electrical circuit diagram of the time delay initiator.

Referring now to the drawings wherein like numbers represent like parts in the separate figures, FIG. 1 discloses an electrical circuit embodying the inventive concept. First and second thermal batteries 10 and 20 provide parallel systems for actuating respective pyrotechnic squibs 30 and 40 of the rocket motor. A timing circuit 50 is disposed between the batteries and the firing squibs for delaying application of the squib firing voltage a preselected time interval.

An input triggering voltage B+ is coupled through leads connected to input terminals 2 and 4 of batteries 10 and 20 which have inputs connected in parallel. Within each battery, electric matches 12 have the electric leads thereof coupled across terminals 2 and 4. Output terminals 1 and 3 of battery 10 are coupled to a Micro Switch 52 within timer circuit 50, with terminal 1 being coupled to a normally closed contact and terminal 3 being coupled to a normally open contact of the switch. The switching contact is coupled to one lead of firing squib 30. The other lead of squib 30 is coupled in common with one lead of squib 40, terminal 1 of battery 10, and terminal 3 of battery 20. Battery 20 has the opposite switching arrangement for the output terminals, terminal 3 being coupled through the normally closed contact of switch 54 to the other terminal squib 40 and terminal 1 being coupled to the normally open contact of switch 54.

Obviously several types of switches may be connected to provide this coupling arrangement between the batteries and the firing squibs. A single-pole double-throw switch is shown in the drawings. With the switches as shown, squibs 30 and 40 have all of their input terminals tied in common so that no spurious or unwanted signals can be coupled across the squibs. The outputs of batteries 10 and 20 are coupled to an open circuit.

The input terminals 2 and 4 of battery 10 are also coupled across parallel dimple motors or actuators 56 for coupling the input B+ signal thereto. Actuators 56 are disposed adjacent a spring loaded timer 58 for activating the timer when B+ is momentarily applied to the system. The timer 58 has a cammed shaft for contact with Micro Switches 52 and 54 after a selectable period of shaft rotation to activate the switches.

The dimple motor is a self-contained, pyrotechnic actuator wherein an electrical impulse activates explosives within a sealed container. When fired, one end of the container changes from a dimpled or concave surface to a nippled surface, Thus, dimple motor 56 uses an electrical input and pyrotechnic reaction to provide a mechanical output which releases the latch or other holding means of timer 58, allowing rotation of the shaft thereof.

Spring wound timer 58 functions as a mechanical clock. When wound up, it is prevented from running down or timing out by a clutch mechanism, latch or other similar engaging member which engages the balance staff or otherwise prevents shaft rotation as is well established in the art. Typically, a bar engaging a groove in the timer shaft can prevent rotation until removed from the groove as by pivoting around a pivot point when pressure is applied to a free end of the bar. Cams on the shaft are positioned to mechanically control and thereby activate the Micro Switches 52 and 54 positioned adjacent the shaft after an adjustable time interval of shaft rotation.

Figure 2:
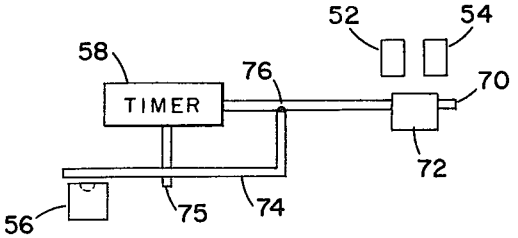
FIG. 2 is a diagrammatical drawing of a typical timing circuit with extraneous support structure omitted.

This typical arrangement of a timing circuit which can provide the mechanical coupling of the system is shown in FIG. 2. Timer 58 is shown to have a shaft 70 on which a cam 72 is mounted. A lever 74 pivots on a fixed pin 75 and engages the shaft at notch 76 to prevent rotation. Dimple motor 56 lies adjacent lever 74 and when activated, contacts the lever, causing the lever to pivot and release shaft 70 for rotation. Cam 72 then rotates into contact with switches 52 and 54.

The thermal battery includes a solid state electrolyte therein which is non-conductive until it is heated to a relatively high temperature when it becomes fluid. Heat generating paper is disposed in layers between or adjacent solid electroyte layers. The heat paper is ignited with an electric match within the battery and quickly elevates the electrolyte temperature to the melting point, thereby activating the battery. The electric match is a highly reliable pyrotechnic device wherein burning is initiated by application of an electric current.

In operation, when a voltage pulse (B+) is supplied, the dimple motors 56 are activated simultaneously with the electric matches 12. As the dimple motors initiate timing by allowing the spring wound timer 58 to operate, the electric matches activate the electrolyte in thermal batteries 10 and 20. The batteries output voltage rapidly establish, timer 58 times out and the Micro Switches are activated, switching the rocket motor firing squibs across their respective batteries 10 and 20.

Either dimple motor may activate the timer and either one of the matches may activate the battery. Thus, redundant system are provided providing increased reliability and also allowing the two squibs 10 and 20 in the motor igniter basket to be short-circuited when the timer is in the wound position and connected to their respective batteries at time out.

Obviously various modifications and variations of the present invention are possible in light of the above disclosure. For example, the spring-wound timer may be cammed to throw selected switches sequentially. Annunciation or telemetering signals may be activated through the timer switching to provide a monitor for the system. Therefore, within the scope of the appended claims, it is to be understood that, the invention can be practiced otherwise than as specifically disclosed herein.

I claim:

1. A time delay initiator comprising: a timing circuit having a trigger input, plural power inputs, and plural outputs for coupling to load circuitry; said timing circuit comprises a spring wound timer having a rotatable shaft and disposed for activation by said trigger input, and plural switches coupled between said power inputs and outputs for coupling power therebetween, said switches being disposed adjacent the shaft of said timer for activation during shaft rotation; a first thermal battery having an input and having an output coupled to a first of said plural power inputs; and means coupled to said battery input for activating said battery.

2. A time delay initiator as set forth in claim 1 wherein said timing circuit further comprises actuator means coupled between said trigger input and said timer for activating said timer in response to an electrical trigger input.

3. A time delay initiator as set forth in claim 2 wherein said thermal battery further comprises an electric match coupled across said input terminals for initiating battery charging in response to a momentary electrical impulse.

4. A time delay initiator as set forth in claim 3 and further comprising a second thermal battery having the input thereof in parallel with the first battery input and having the output coupled to a second of said timing circuit power inputs.

5. A time delay initiator as set forth in claim 4 wherein said load circuitry includes first and second squib initiators for activating a rocket motor, and said plural switches are first and second singlepole double-throw switches having normally closed contacts coupled across said squib initiators for maintaining a short-circuit thereacross prior to activation of said switches, said switches being coupled to said batteries for individually placing the output of said batteries across respective squibs when said switches are activated.

* * * * *